US005139621A

United States Patent [19]

Alexander et al.

[11] Patent Number: 5,139,621

[45] Date of Patent: Aug. 18, 1992

[54] AZEOTROPIC DISTILLATION PROCESS FOR RECOVERY OF DIAMONDOID COMPOUNDS FROM HYDROCARBON STREAMS

[75] Inventors: Richard A. Alexander, Mobile, Ala.; D. Duayne Whitehurst, Titusville, N.J.

[73] Assignee: Mobil Oil Corporation, Fairfax, Va.A

[21] Appl. No.: 535,633

[22] Filed: Jun. 11, 1990

[51] Int. Cl.[5] ..... B01D 3/36

[52] U.S. Cl. ..... 203/54; 203/62; 203/92; 203/95; 252/DIG. 9; 585/15; 585/800

[58] Field of Search ..... 203/92, 95, 54, 62, 203/63; 585/800, 15; 252/DIG. 9

[56] References Cited

U.S. PATENT DOCUMENTS

| | | | |
|---|---|---|---|
| 2,375,478 | 5/1945 | Lake et al. | 203/55 |
| 2,442,474 | 6/1948 | Scarth | 203/54 |
| 2,459,403 | 1/1949 | Ahrens | 203/54 |
| 2,462,025 | 2/1949 | Lake et al. | 203/54 |
| 2,563,344 | 8/1951 | Leffert et al. | 203/54 |
| 3,897,390 | 7/1975 | Groult et al. | 528/38 |
| 4,952,747 | 8/1990 | Alexander et al. | 585/352 |
| 4,952,748 | 8/1990 | Alexander et al. | 585/352 |
| 4,952,749 | 8/1990 | Alexander et al. | 585/352 |
| 4,982,249 | 1/1991 | Alexander et al. | 208/335 |

FOREIGN PATENT DOCUMENTS 0399851 11/1990 European Pat. Off. .

OTHER PUBLICATIONS

McKervey, "Synthetic Approaches to Large Diamondoid Hydrocarbons", Sep., 1979 pp. 971 to 992.

W. Burns et al., "A New Approach to the Construction of Didmondoid Hydrocarbons," Feb. 1, 1978, American Chemical Society, pp. 906–911.

Fort, Jr., R. C., The Chemistry of Diamond Molecules, Marcel Dekker, 1976.

Sax et al., Hawley's Condensed Chemical Dictionary, 11 ed., (1987), p. 109.

Kirk–Othmer Encyclopedia of Chemical Technology, 3rd ed. (1978), p. 352, vol. 3.

*Primary Examiner*—Virginia Manoharan

*Attorney, Agent, or Firm*—Alexander J. McKillop; Charles J. Speciale; Robert B. Furr, Jr.

[57] ABSTRACT

An azeotropic distillation method for separating diamondoids from a near-boiling solvent. The method is particularly useful for recovering diamondoids extracted from a produced natural gas stream via hydrocarbon solvent injection.

19 Claims, 6 Drawing Sheets

AZEOTROPIC DISTILLATION PROCESS FOR RECOVERY OF DIAMONDOID COMPOUNDS FROM HYDROCARBON STREAMS

FIELD OF THE INVENTION

This invention relates to an improved process for separating diamondoid compounds from hydrocarbon solvents. More particularly, the invention relates to the use of azeotropic distillation to fractionate diamondoid compounds from hydrocarbon solvents having boiling ranges similar to that of the dissolved diamondoid compounds.

BACKGROUND OF THE INVENTION

Natural gas production may be complicated by the presence of certain heavy hydrocarbons in the subterranean formation in which the gas is found. Under conditions prevailing in the subterranean reservoirs, the heavy hydrocarbons may be partially dissolved in the compressed gas or finely divided in a liquid phase. The decrease in temperature and pressure attendant to the upward flow of gas as it is produced to the surface result in the separation of solid hydrocarbonaceous material from the gas. Such solid hydrocarbons may form in certain critical places such as on the interior wall of the production string, thus restricting or actually plugging the flow passageway.

Many hydrocarbonaceous mineral streams contain some small proportion of these diamondoid compounds. These high boiling, saturated, three-dimensional polycyclic organics are illustrated by adamantane, diamantane, triamantane and various side chain substituted homologues, particularly the methyl derivatives. Diamondoid compounds have high melting points and high vapor pressures for their molecular weights and have recently been found to cause problems during production and refining of hydrocarbonaceous minerals, particularly natural gas, by condensing out and solidifying, thereby clogging pipes and other pieces of equipment. For a survey of the chemistry of diamondoid compounds, see Fort, Jr., Raymond C., *The Chemistry of Diamond Molecules*, Marcel Dekker, 1976.

In recent times, new sources of hydrocarbon minerals have been brought into production which, for some unknown reason, have substantially larger concentrations of diamondoid compounds. Whereas in the past, the amount of diamondoid compounds has been too small to cause operational problems such as production cooler plugging, now these compounds represent both a larger problem and a larger opportunity. The presence of diamondoid compounds in natural gas has been found to cause plugging in the process equipment requiring costly maintenance downtime to remove. On the other hand, these very compounds which can deleteriously affect the profitability of natural gas production are themselves valuable products.

Various processes have been developed to prevent the formation of such precipitates or to remove them once they have formed. These include mechanical removal of the deposits and the batchwise or continuous injection of a suitable solvent. Recovery of one such class of heavy hydrocarbons, i.e. diamondoid materials, from natural gas is detailed in commonly assigned allowed U.S. patent application Ser. No. 405,119, filed Sep. 7, 1989, which is a continuation of Ser. No. 358,758, filed May 26, 1989, now abandoned, as well as allowed U.S. patent application Ser. Nos. 358,759; 358,760; and 358,761, all filed May 26, 1989. The text of these allowed U.S. patent applications is incorporated herein by reference.

Research efforts have more recently been focused on separating diamondoid compounds from the liquid solvent stream described, for example, in the above cited U.S. patent application Ser. No. 405,119. The diamondoid and solvent components have proven difficult to separate via conventional multistage distillation due at least in part to the overlapping boiling ranges of the preferred solvents and the commonly occurring diamondoid compounds. Further, the diamondoid compounds have been found to deposit precipitate in the overhead condenser circuit of a solvent distillation apparatus. Developing the commercial potential of these valuable components is then predicated upon the discovery of an economical method for separating diamondoids from the solvent.

Many compounds are known to form azeotropes, liquid mixtures of two or more substances which behave as a single substance in that the vapor produced by partial evaporation of liquid has the same composition as the liquid. Azeotropic distillation, then, is a type of fractionation in which a substance is added to the mixture to be separated in order to form an azeotropic mixture with one or more of the components of the original mixture. The azeotrope or azeotropes thus formed will have boiling points different from the boiling points of the original mixture, thus facilitating separation. See Sax and Lewis, *Hawley's Condensed Chemical Dictionary*, 109 (11th ed., 1987) and 3 *Kirk-Othmer Encyclopaedia of Chemical Technology* 352 (3rd ed., 1978).

Whether an azeotrope will form at all, as well as whether the resulting azeotropic mixture will boil at a temperature above or below that of the original mixture, cannot readily be predicted. Developing an azeotropic fractionation process which would be practical on an industrial scale presents a still greater challenge because the selected co-distillate must not only form an azeotrope which is readily separable from the original mixture, but must also be available at a reasonable cost.

SUMMARY OF THE INVENTION

In accordance with the present invention, it has been found that diamondoid compounds form azeotropes with water, and that these azeotropes exhibit sufficiently different boiling points from the original mixture to facilitate separation of the diamondoid compounds from commonly used hydrocarbon solvents. It has further been discovered that furfural, water, certain alcohols, and diamondoid compounds form azeotropes which not only facilitate their separation from hydrocarbon solvents by azeotropic distillation, but also improve distillation tower efficiency by their antifoaming action.

In a first process aspect, the present invention provides a method for separating a diamondoid compound from a hydrocarbon solvent comprising an azeotropic distillation with water in amounts sufficient to cause an azeotrope with said diamondoid compound.

In a second process aspect, the present invention provides a method for separating a diamondoid compound from a hydrocarbon solvent comprising an azeotropic distillation with water and furfural in amounts sufficient to form a three-component azeotrope with said diamondoid compound.

In a third process aspect, the present invention provides a method for removing a diamondoid compound and at least one of $CO_2$ and $H_2S$ from a hydrocarbon solvent containing the same comprising the steps of steam stripping said hydrocarbon solvent with sufficient steam to strip $CO_2$ or $H_2S$ from said hydrocarbon solvent and to form an azeotrope with said diamondoid compound.

In a fourth process aspect, the present invention provides a method for extracting diamondoid compounds from a hydrocarbon gas containing the same, comprising the steps of:

providing a hydrocarbon gas stream containing a recoverable concentration of at least one diamondoid compound;

contacting said hydrocarbon gas stream with a liquid hydrocarbon solvent in which said diamondoid compound is at least partially soluble to dissolve said diamondoid compound in said liquid hydrocarbon solvent; and distilling said diamondoid-containing hydrocarbon solvent of step (b) in the presence of water sufficient to cause an azeotrope with said diamondoid compound.

DESCRIPTION OF THE DRAWINGS

FIG. 4 illustrates the effect of the addition of normal heptane as a co-distillate.

FIG. 5 illustrates the effect of the addition of normal propanol as a co-distillate.

FIG. 6 illustrates the effect of the addition of furfural and water as co-distillates.

DETAILED DESCRIPTION

Figure 1:
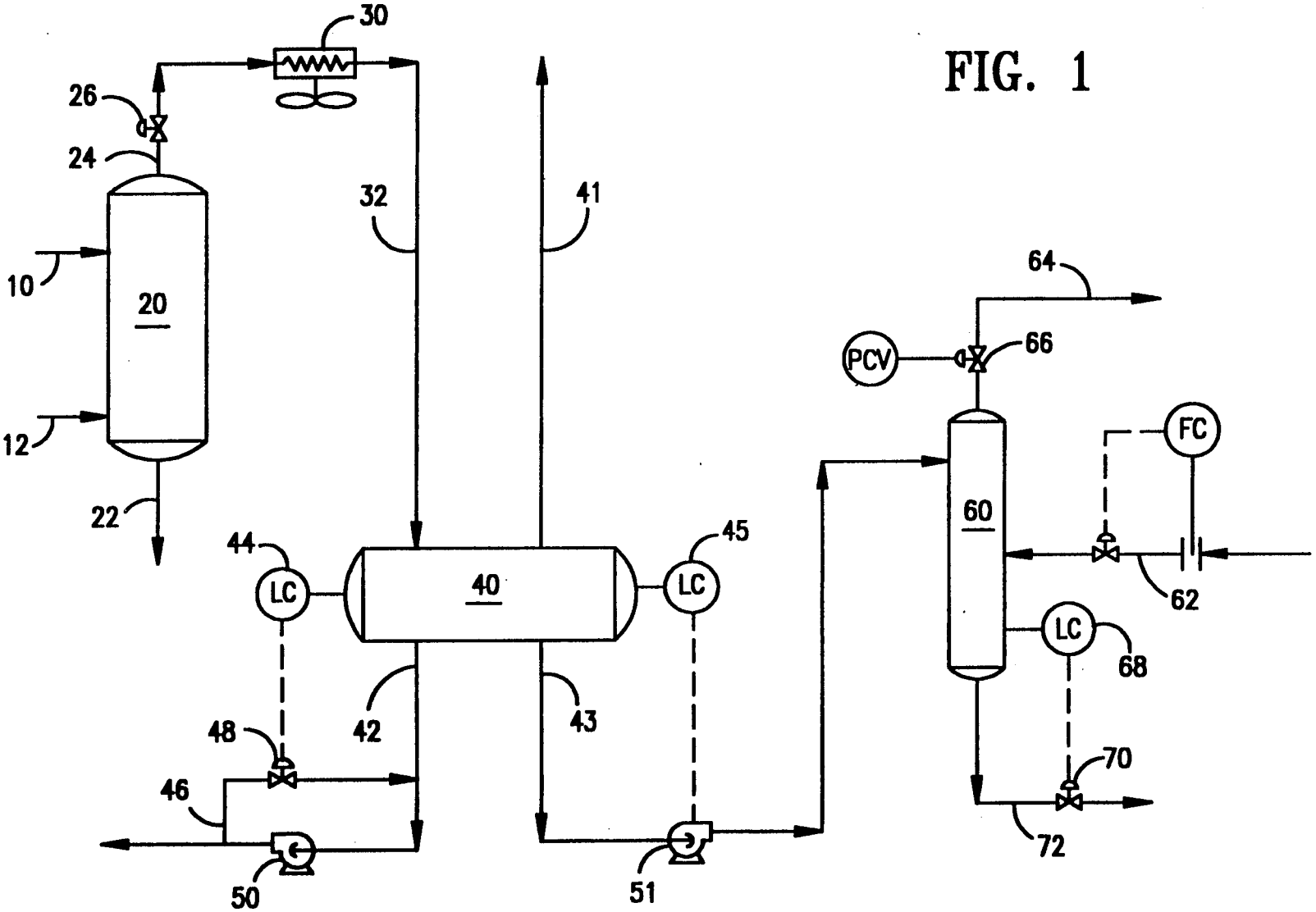
FIG. 1 is a simplified schematic representation of the major processing steps of one embodiment of the present invention.

The present invention provides a method for separating diamondoid compounds from solvents having at least one diamondoid compound dissolved therein which comprises forming a diamondoid-water azeotrope and effecting fractionation of the azeotropic mixture from the solvent. The invention further provides a method for separating diamondoid compounds from solvents having at least one diamondoid compound dissolved therein which comprises forming a diamondoid-water-furfural azeotrope and effecting fractionation of the three component azeotrope from the solvent.

The term "diamondoid" as used herein defines a family of organic molecules having a common skeletal structure. The first member of the diamondoid family of molecules is adamantane. Adamantane, tricyclo-[3.3.3.1$^{3,7}$]decane, is a polycyclic alkane with the structure of three fused cyclohexane rings. The ten carbon atoms which define the framework structure of adamantane are arranged in an essentially strainless manner. For a general survey of the chemistry of diamondoid molecules, see Adamantane, *The Chemistry of Diamond Molecules*, Raymond C. Fort, Marcel Dekker, New York, 1976. Adamantane is the smallest member of the group referred to herein as diamondoid molecules, which further includes diamantane, triamantane, and the higher adamantalogs as well as the corresponding substituted structures.

The solvent from which the diamondoid compound is to be separated is most typically a hydrocarbon solvent. This solvent may comprise any mixture of paraffins, olefins, naphthenes, and aromatics which readily dissolves the diamondoid component and is preferably a petroleum distillate fraction boiling within the range of from about 50° to about 450° C. (120° to 842° F.). Useful solvents include naphtha cuts having boiling ranges of from about 150° C. to about 205° C. (302° to 401° F.), kerosene cuts having boiling ranges of from about 180° C. to about 300° C. (356° F. to 572° F.), and heavier distillates boiling in the range of about 285° C. to about 455° C. (550° to 850° F.). Mixtures having a relatively narrow boiling range may also be useful solvents. The azeotropic distillation of diamondoid compounds from near-boiling hydrocarbon solvents is described in greater detail in Examples 1–7, below.

Diamondoids present in natural gas streams may be effectively removed by contacting the natural gas stream with a suitable solvent as described above. Diamondoid compounds are not, however, the only undesirable constituent which can be contained in natural gas streams as they are produced from the well. The diamondoid-containing natural gas streams also tend to contain acid gases such as $CO_2$ and $H_2S$, and, due to the resulting corrosivity and characteristic odor of such natural gas streams, are commonly called sour gas streams. The corrosive nature of these natural gas streams becomes even more pronounced at the lower temperatures found in the processing equipment commonly called the production string. The solvent which is circulated to prevent diamondoid deposition has been found to dissolve these sour gases. To avoid accumulation of acidic compounds in the circulating solvent system, the solvent must be stripped of acid gases.

The diamondoid-enriched circulating solvent typically contains up to about 15% by weight diamondoid compounds when it is charged to the azeotropic distillation process of the present invention. Thus it is particularly advantageous that the diamondoid-water azeotrope as well as the diamondoid-furfural-water and diamondoid-n-propanal-water azeotropes exhibit lower boiling points than the original mixture. The boiling point depression is uniquely desirable in the present invention because the lower volume constituents, i.e. the sour gases and the diamondoid azeotrope, are separated from the bulk of the solvent stream in the first fractionation tower. Thus the mass flowrate of the overhead stream which contains both the diamondoid azeotrope and the acid gases is typically less than about 15% of the diamondoid-enriched circulating solvent flow. This overhead stream is then stripped of acid gases in a relatively small downstream stripper tower.

In contrast, if the co-distillate of the invention elevated the azeotropic boiling point, the initial fractionation required would be completely different and far more expensive. The overhead stream from the first fractionation tower, having a mass flowrate of about 85% of the total feed, would contain hydrocarbon solvent and sour gases while the bottom stream would be enriched in a higher boiling diamondoid azeotrope. The overhead stream would then be stripped of acid gases. But the acid gas stripper, as well as the first fractionation tower overhead condenser and condensate pump, would be required to process more than 5 times the mass flow in comparison to the corresponding equipment used to process a lower boiling diamondoid azeotrope.

Referring now to FIG. 1, a diamondoid-enriched stream comprising diesel fuel with about 15% by weight of diamondoid compounds dissolved therein is charged to a first fractionation tower 20 through line 10. Steam is introduced near the bottom of fractionation tower 20 through line 12 at a rate of about 100 to 1000 pounds of steam per pound of feed. The configuration of fractionation tower 20 is not critical and may comprise any suitable distillation tower configuration commonly used by those skilled in the art. For example fractionation tower 20 may contain trays, packed beds, or a combination of both.

The lean diesel fuel solvent is withdrawn from fractionation tower 20 through line 22 and is recycled for injection into a natural gas processing facility (not shown) as described above. The overhead distillate is withdrawn from fractionation tower 20 through line 24 which is equipped with pressure control valve 26 to maintain pressure within fractionation tower 20 at about 25 psig.

The overhead distillate flows to overhead condenser 30 where it is partially condensed, and then continues through line 32 to decanter/accumulator 40. Overhead condenser 30 is shown as an air cooled exchanger but may comprise any suitable condenser such as one or more water cooled condensers.

Decanter/accumulator 40 retains the overhead condensate for a period of time sufficient to permit separation of the liquid phases into an upper diamondoid-containing hydrocarbon phase and a lower sour water phase, and to disengage the condensed liquids from the noncondensible overhead gases which are conveyed to a sour gas treatment facility (not shown) through line 41. The sour water flows from decanter/accumulator 40 to a process sewer (not shown) through line 42 which is equipped with sour water pump 50. Sour water level within the decanter/accumulator is regulated by level controller 44 which sets flowrate through recycle line 46 via control valve 48.

The diamondoid-containing hydrocarbon phase is withdrawn from decanter/accumulator 40 through line 43 which is equipped with overhead product pump 51. Level controller 45 regulates flow of the diamonoid-containing phase through overhead product pump 51.

The diamondoid-containing hydrocarbon phase from the decanter/accumulator flows through line 43 to an upper tray of the sour gas stripper 60. The temperature within the sour gas stripper 60 is maintained at about 120° F. and pressure is controlled at about 175 psig. Stripping gas, typically methane-rich fuel gas, enters a lower section of sour gas stripper 60 through line 62 at a flowrate of from about 30 to about 500 SCF/gallon of feed. The enriched stripped gas, containing $CO_2$, $H_2S$, or both, is withdrawn from sour gas stripper 60 through overhead vapor line 64 which is equipped with pressure control valve 66 and charged to a sour gas treatment facility (not shown) as described above. Level controller 68 and flow control valve 70 regulate the flow of diamondoid-enriched product withdrawn from the bottom of sour gas stripper 60 through line 72.

In the most preferred embodiment, the diamondoid-enriched stream charged to the first fractionation tower 20 through line 10 is a slip stream of solvent withdrawn from a solvent circulation system as taught in commonly assigned U.S. Pat. No. 4,952,748 to Alexander and Knight. The disclosure of this U.S. Patent is incorporated by reference as if set forth at length herein for its description of a method for removing diamondoid components from a hydrocarbon gas stream, for example a natural gas stream.

The present process is therefore most preferably sized to remove diamondoid constituents from the solvent stream at approximately the same rate as they are dissolved into the solvent stream from a hydrocarbon gas stream. Certain constituents sorbed from the hydrocarbon gas stream may boil in nearly the same range as the solvent and for this reason may be concentrated in the solvent after recycling the solvent through repeated sorption and distillation steps. Thus the process may require periodic withdrawal of enriched solvent and addition of fresh solvent at intervals which are easily determined by one skilled in the art with a minimum of trial and error.

EXAMPLES

Comparative distillations were conducted on a feed mixture comprising approximately 15 weight % total diamondoids dissolved in an aromatic diesel fuel formulated with corrosion inhibitors. The corrosion inhibitors listed are available from the Tretolite Company of St. Louis, Mo. The composition of this diesel fuel solvent is shown in Table 1. The type and concentration of diamondoid compounds contained in the aromatic diesel fuel are summarized in Table 2.

TABLE 1

| COMPOSITION OF DIESEL FUEL SOLVENT BOILING POINT DISTRIBUTION, °F. | |
|---|---|
| 5% | 363 |
| 10% | 399 |
| 20% | 441 |
| 30% | 471 |
| 40% | 495 |
| 50% | 523 |
| 60% | 550 |
| 70% | 584 |
| 80% | 624 |
| 90% | 670 |
| 95% | 701 |
| **HYDROCARBON TYPE DISTRIBUTION** | |
| Aromatics | 46–58% |
| Paraffins | 22–29% |
| 1-ring naphthenes | 12–18% |
| 2-ring naphthenes | 5–6% |
| 3-ring naphthenes | 1–3% |

Corrosion-inhibiting additives (Tretolite Brand)
KP-111 0.8% Corrosion Inhibitor (carboxylic acid/polyamine)
KW-151 400 ppm Corrosion Inhibitor (thioalkyl substituted phenolic heterocycle)
D-91 <100 ppm Antifoam (silicone antifoam in hydrocarbon solvent)

TABLE 2

DIAMONDOID DISTRIBUTION IN ENRICHED DIESEL FUEL SOLVENT

| Compound | % Abundance | Boiling Pt, °F. |
|---|---|---|
| Adamantane | 12.7 | 386 |
| 1-Methyladamantane | 31.3 | 394 |
| 1,3-Dimethyladamantane | 20.8 | 400 |
| 1,3,5-Trimethyladamantane | 5.1 | 403 |
| 2-Methyladamantane | 1.3 | 415 |

TABLE 2-continued

DIAMONDOID DISTRIBUTION IN ENRICHED DIESEL FUEL SOLVENT

| Compound | % Abundance | Boiling Pt, °F. |
|---|---|---|
| 1-Ethyl-3-Methyladamantane | 1.2 | 443 |
| Diamantane | 8.5 | 529 |
| 4-Methyldiamantane | 6.1 | 534 |
| 1-Methyldiamantane | 2.8 | 545 |
| Trimantane | 1.2 | 647 |
| 1-Methyltrimantane | 1.0 | 648 |
| Other Diamondoids | 8.0 | |

EXAMPLE 1

Conventional Distillation

Figure 2:
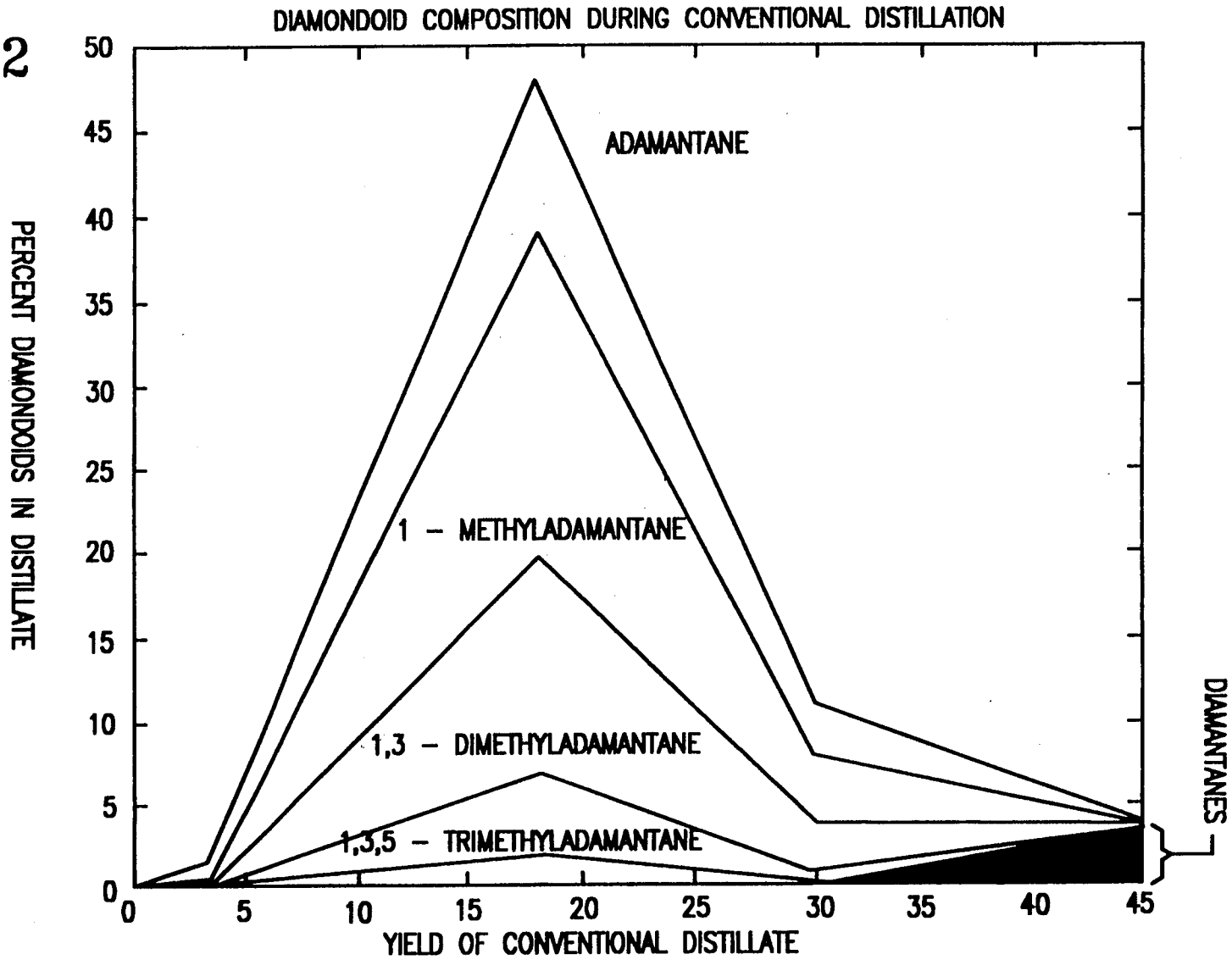
FIG. 2 is a plot of the diamondoid content of the overhead distillate product in weight percent from a conventional distillation as a function of weight percent total yield.

A first sample of the feed mixture identified above was distilled and fractions were collected every 50° F. FIG. 2 shows the composition of each fraction as a function of the amount of material distilled, showing that the diamondoids appear in the overhead distillate product in a sequential manner. The fractions in which the diamondoids appeared were consistent with the boiling points of the individual diamondoids shown above in Table 2. Thus, conventional distillation of diamondoid-containing diesel fuel failed to effect the desired concentration of diamondoid constitutents.

EXAMPLE 2

Two-Component Azeotrooic Distillation

Figure 3:
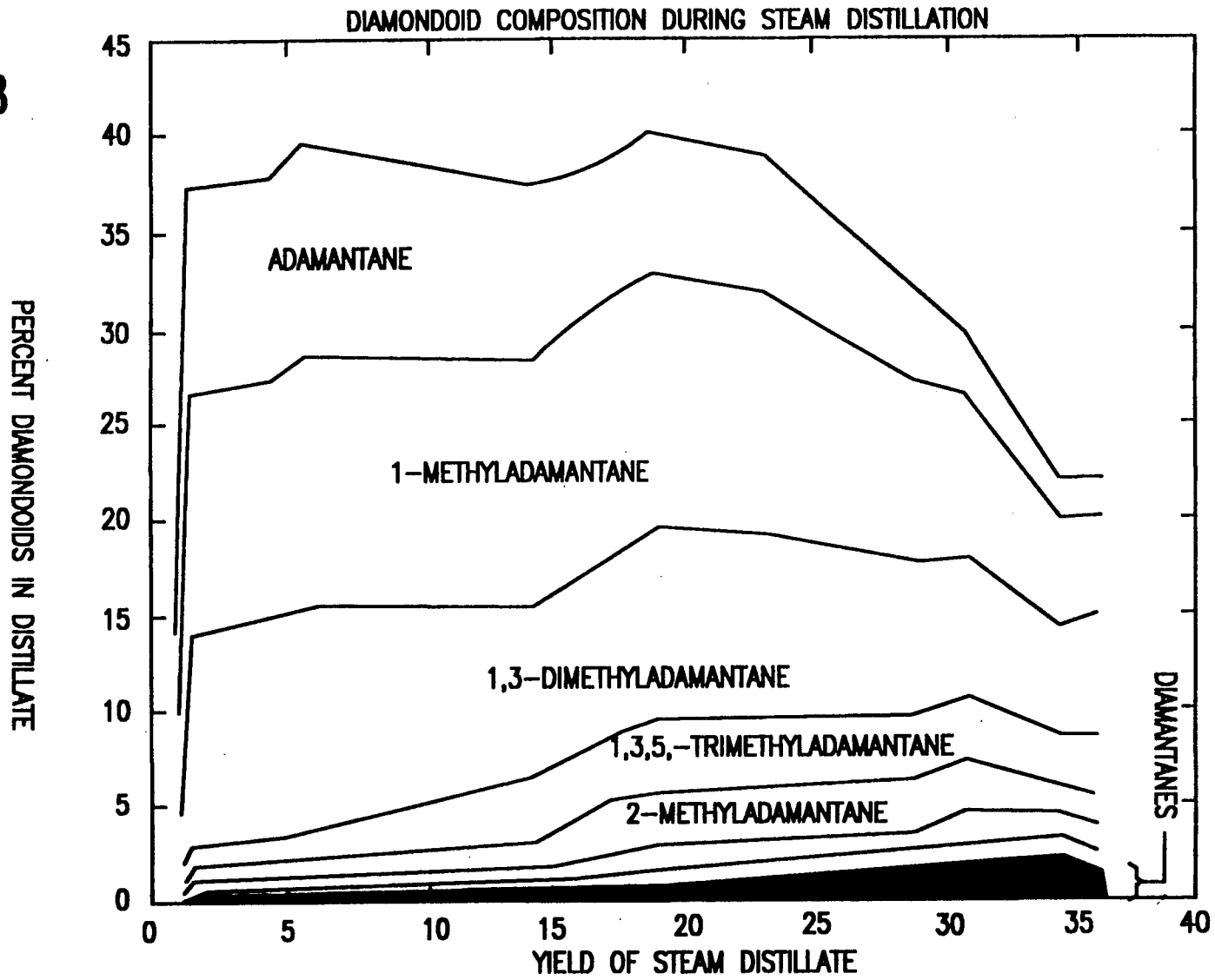
FIG. 3 is a plot of the diamondoid content of the overhead distillate product in weight percent from an azeotropic (steam) distillation as a function of weight percent total yield.

A second sample of the feed mixture identified above was distilled with continuous water addition during the distillation. The pot temperature was initially set at 120° C. and slowly raised to about 140° C. The azeotropic distillation temperatures observed were far below those of the normal boiling points of th diamondoid compounds. FIG. 3 shows the results of this azeotropic distillation. Surprisingly, at 1% by weight of the starting material distilled, diamantane was present in significant quantities in the overhead distillate. FIG. 3 shows a slight preference for the lower boiling diamondoids in the early fractions but the overall distillation profile is clearly and surprisingly different from that of the conventional distillation shown in FIG. 2. These results show that diamondoid compounds can be selectively recovered from mixtures of a wide variety of other hydrocarbons by azeotropic distillation with water.

EXAMPLES 3-5

The following experiments were conducted to determine whether diamondoid compounds, specifically adamantane and diamantane, exhibited azeotropic behavior with co-distillates other than water. To accurately quantify the effects of the co-distillates, a model compound mixture was prepared having the composition shown below in Table 3. The solvent constituents were chosen such that their boiling points bracketed that of adamantane and diamantane.

TABLE 3

MODEL COMPOUND MIXTURE USED FOR AZEOTROPIC DISTILLATION STUDIES

| Compound | BPT, °F. | gr | % |
|---|---|---|---|
| n-Butylbenzene | 362 | 2 | 4.5 |
| Adamantane | 383 | 2 | 4.5 |
| n-Undecane | 384 | 18 | 41.0 |
| n-Tetradecane | 488 | 2 | 4.5 |
| Diamantane | 529 | 2 | 4.5 |

TABLE 3-continued

MODEL COMPOUND MIXTURE USED FOR AZEOTROPIC DISTILLATION STUDIES

| Compound | BPT, °F. | gr | % |
|---|---|---|---|
| n-Nonylbenzene | 539 | 18 | 41.0 |

Selected properties of the constituents of the model compound mixture are shown in Tables 4 and 5.

TABLE 4

PROPERTIES OF SELECTED HYDROCARBONS

| Compound | # C | BPT, °F. | Vapor Pressure (mm Hg) 212° F. | 140° F. |
|---|---|---|---|---|
| n-Decane | 10 | 345 | 72 | 11 |
| n-Butylbenzene | 10 | 362 | 56 | 8.9 |
| 2-Methylbutyl-benzene | 11 | 379 | 47 | 7.2 |
| Adamantane | 10 | 383 | 16 | 1.9 |
| n-Undecane | 11 | 384 | 33 | 4.4 |
| n-Tetradecane | 14 | 488 | 3.2 | 0.3 |
| n-Pentadecane | 15 | 519 | 1.5 | 0.1 |
| Diamantane | 14 | 536 | 0.8 | 0.08 |
| n-Nonylbenzene | 15 | 539 | 1.2 | 0.1 |

TABLE 5

PROPERTIES OF CO-DISTILLATES USED IN THIS STUDY

| Co-Distillate | % (of mix) | BPT, °F. (of mix) | Mol wt | gr/0.684 moles (of mix) |
|---|---|---|---|---|
| n-Heptane | 100 | 209 | 100 | 68.4 |
| n-Propanol | 72 | 190 | 60 | 24.9 |
| Water | 28 | | 18 | |
| Furfural | 35 | 208 | 96 | 17.2 |
| Water | 65 | | 18 | |

Distillations were conducted at pressure of 100 mm Hg and temperature of 140° F. A uniform quantity (0.68 mole) of co-distillate was distilled from the distillation pot. Table 6 shows the results for Examples 3-5.

TABLE 6

SELECTIVITY IN HYDROCARBON AZEOTROPIC DISTILLATION (0.68 moles co-distillate, 140° F., 100 mm Hg)

| Compound | BPT, °F. | Example 3 Heptane | Example 4 n-PrOH Water | Example 5 Furfural Water |
|---|---|---|---|---|
| | | PERCENT OF COMPONENT DISTILLED Co-distillate | | |
| n-Butylbenzene | 362 | 13.4 | 38.7 | 79.4 |
| Adamantane | 383 | 10.5 | 39.0 | 85.4 |
| n-Undecane | 384 | 2.0 | 18.0 | 43.1 |
| n-Tetradecane | 488 | 2.5 | 1.9 | 5.6 |
| Diamantane | 529 | 3.2 | 3.5 | 7.1 |
| n-Nonylbenzene | 539 | 0 | 2.6 | 13.4 |

Figure 4:
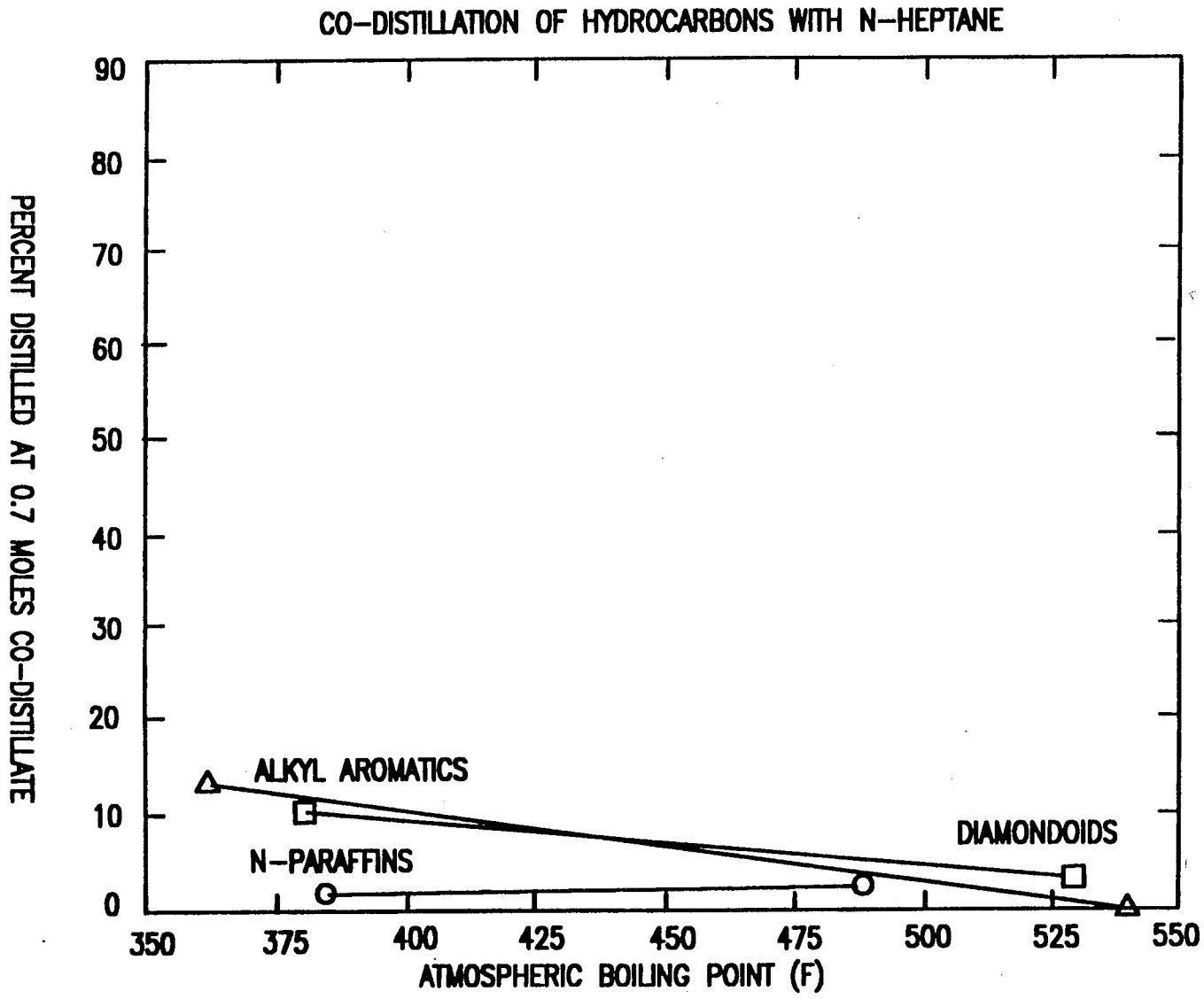
FIGS. 4–6 compare the effects of various co-distillates, showing the weight percent of alkyl aromatics, normal paraffins, and diamondoids in the overhead distillate product at 0.7 moles of co-distillate as a function of atmospheric boiling point.
Figure 5:
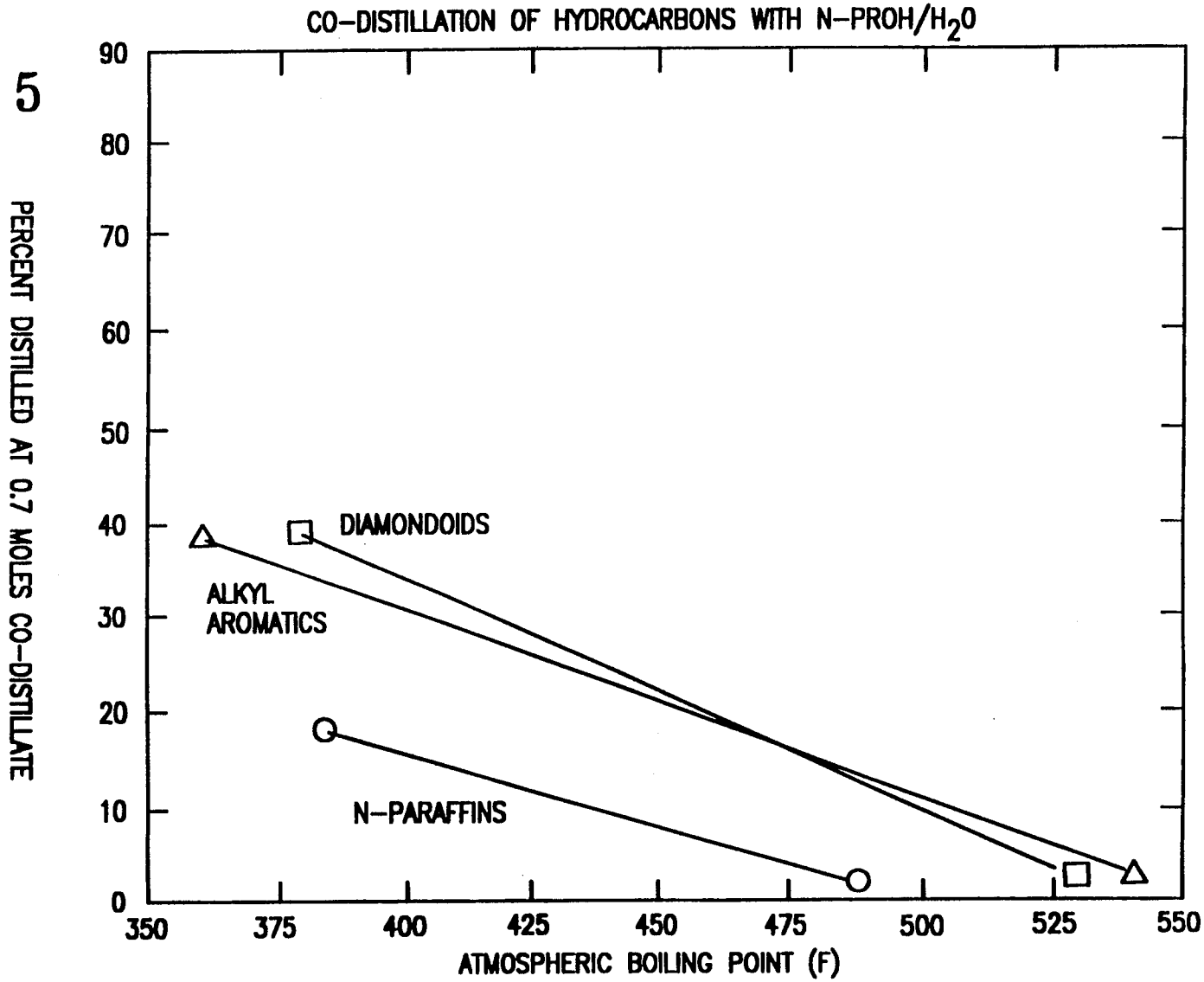
Figure 6:
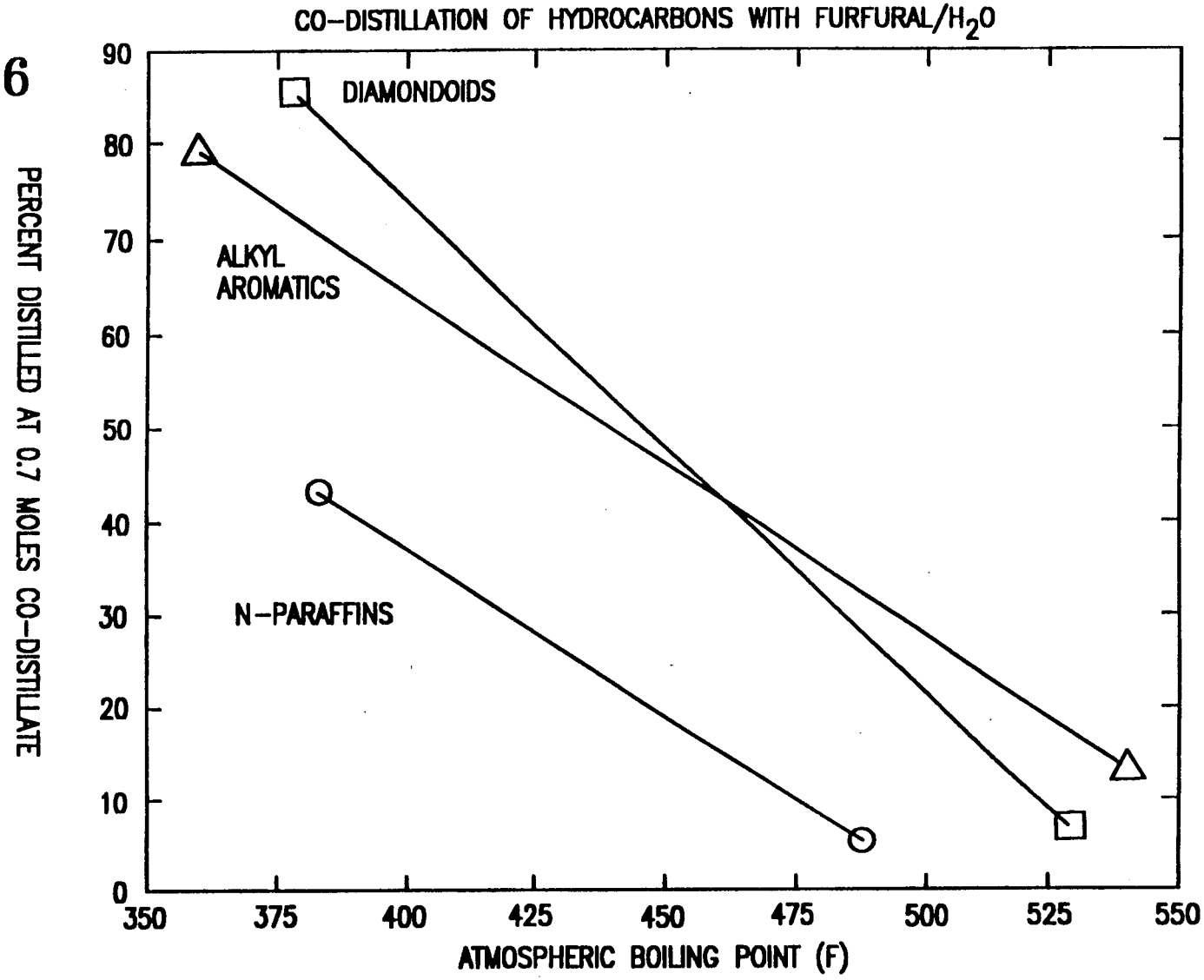

Normal heptane was found to provide no advantage for selective co-distillation to enhance the separation of diamondoids from the model compound mixture. By contrast, polar co-distillates such as normal propanol-water and furfural-water form azeotropes with diamondoid compounds in preference to other classes of hydrocarbons having the same boiling points and can thus be selectively concentrated by azeotropic distillation. FIGS. 4-6 show the percent of various compounds distilled with a given amount of co-distillate as function of the atmospheric boiling point of the compounds in question. The preference for selective co-distillation of diamondoids relative to paraffins is clearly evident. Surprisingly, aromatics, which are known to form azeotropes, appear to do so less readily with the co-distillates under examination than the lower boiling diamondoids. The corrosion inhibitors present in the diesel fuel solvent are largely aromatic and beneficially tend to remain in the diesel fuel during the azeotropic distillation.

Furfural was found not only to form a three-component azeotropic with water and diamondoid but was also found to improve fractionation tower operation as a foaming inhibitor. Tower temperatures above about 250° F. (120° C.) were also found to decrease foaming.

EXAMPLE 6

Azeotropic distillation of Diamondoid-containing Diesel Fuel with Furfural/Water Co-Distillate A diesel fuel-based feed was prepared which contained both diamondoid compounds as well as model compound tracers. The composition of this diesel fuel-based distillation feedstock is shown in Table 7. The model compound tracers, undecane and dodecane, boil at or near the boiling points of the diamondoid compounds in the feedstock and serve to highlight the boiling point change attributable to formation of diamondoid azeotropes.

Distillation was conducted and 100 mm Hg and 160° F. A total of 0.68 mole total of combined furfural and water (about 35% furfural and about 65% water by weight) was distilled. The ratio of total hydrocarbon distilled to total furfural/water distilled was about 1:10. The composition of the hydrocarbons which remained in the distillation pot at the termination of the distillation is also shown in Table 7. The data clearly show that a much higher percentage of diamondoids distill relative to normal paraffins having similar boiling points.

TABLE 7

SELECTIVE AZEOTROPIC DISTILLATION OF DIAMONDOIDS
(0.68 moles furfural/water co-distillate, 160° F., 100 mm Hg)

| Compound | BPT, °F. | % Composition Starting | % Composition Final | % Distilled |
|---|---|---|---|---|
| Adamantane | 383 | 5.5 | 2.0 | 65 |
| Undecane | 384 | 1.3 | 0.9 | 26 |
| 1-Methyladamantane | 394 | 11.4 | 5.9 | 51 |
| 1,3-Dimethyl-adamantane | 400 | 7.6 | 4.9 | 36 |
| 1,3,5-Trimethyl-adamantane | 403 | 2.6 | 1.9 | 27 |
| Dodecane | 421 | 18.6 | 17.0 | 8.8 |

These results clearly show the effectiveness of adding water alone or water in conjunction with a second polar co-distillate such as normal propanol or furfural to effect azeotropic distillation of dissolved diamondoids from hydrocarbons solvents having boiling ranges similar to the diamondoids.

Changes and modifications in the specifically described embodiments can be carried out without departing from the scope of the invention which is intended to be limited only by the scope of the appended claims.

What is claimed is:

1. A method for separating a diamondoid compound selected from the group consisting of adamantane, diamantane, triamantane and the alkyl substituted homologs of adamantane, diamantane, and triamantane from a hydrocarbon solvent comprising admixing water with said diamondoid compound in amounts sufficient to cause an azeotrope containing water and said diamondoid compound and separating said diamondoid-water axeotrope from said hydrocarbon solvent by distillation.

2. The method of claim 1 wherein said hydrocarbon solvent comprises a major proportion of $C_{10}$–$C_{20}$ hydrocarbons.

3. The method of claim 1 wherein said hydrocarbon solvent is a petroleum distillate having a boiling range of from about 200° C. to about 500° C.

4. The method of claim 1 wherein the temperature of said azeotropic distillation is maintained above about 120° C.

5. A method for separating a diamondoid compound selected from the group consisting of adamantane, diamantane, triamantane and the alkyl substituted homologs of adamantane, diamantane, and triamantane from a hydrocarbon solvent comprising admixing water and furfural with said diamondoid compound in amounts sufficient to form a three-component azeotrope with said diamondoid compound and separating said diamondoid-furfural-water azeotrope from said hydrocarbon solvent by distillation.

6. The method of claim 5 wherein said hydrocarbon solvent comprises a major proportion of $C_{10}$–$C_{20}$ hydrocarbons.

7. The method of claim 1 wherein said hydrocarbon solvent is a petroleum distillate having a boiling range of from about200° C. to about 500° C.

8. The method of claim 1 wherein the temperature of said azeotropic distillation is maintained above about 120° C.

9. A method for removing a diamondoid compound selected from the group consisting of adamantane, diamantane, triamantane, and the alkyl substituted homologs of admanatane, diamantane and triamantane and at least one of $CO_2$ and $H_2S$ from a hydrocarbon solvent containing the same comprising the steps of steam stripping said hydrocarbon solvent with sufficient steam to strip $CO_2$ or $H_2S$ from said hydrocarbon solvent and to form an azeotrope containing water and said diamondoid compound.

10. The method of claim 9 wherein said hydrocarbon solvent comprises a major proportion $C_{10}$–$C_{20}$ hydrocarbons.

11. The method of claim 9 wherein said hydrocarbon solvent is a petroleum distillate having a boiling range of from about 200° C. to about 500° C.

12. The method of claim 9 wherein the temperature of said azeotropic distillation is maintained above about 120° C.

13. A method for extracting diamondoid compounds from a hydrocarbon gas containing the same, comprising the steps of:

(a) providing a hydrocarbon gas stream containing a recoverable concentration of at least one concentration of at least one diamondoid compound;

(b) contacting said hydrocarbon gas stream with a liquid hydrocarbon solvent in which said diamondoid compound is at least partially soluble to dissolve said diamondoid compound in said liquid hydrocarbon solvent; and (c) distilling said diamondoid-containing hydrocarbon solvent of step (b) in the presence of water sufficient to cause an azeotrope with said diamondoid compound.

14. The method of claim 13 further comprising adding furfural to said hydrocarbon solvent in a quantity sufficient to cause a three component furfural-water-diamondoid azeotrope.

15. The method of claim 14 wherein said hydrocarbon solvent contains aromatics.

16. The method of claim 15 wherein said distilling step (c) is preceded by a solvent extraction step comprising contacting said diamondoid-containing hydrocarbon solvent with furfural to remove aromatics from said hydrocarbon solvent.

17. The method of claim 13 further comprising withdrawing purified solvent from said distillation step (c) and recycling said purified solvent to said contacting step (b).

18. A method for reoovering diamondoid compounds from a gas stream containing said diamondoid compounds comprising contacting said diamondoid compound-containing gas stream with a liquid solvent in which said diamondoid compounds are at least partially soluble to sorb said diamondoid compounds into said liquid solvent, and separating said diamondoid-containing liquid solvent in a fractionation zone to provide a product stream enriched in diamondoid compounds by adding water to said fractionation zone in amounts sufficient to form a diamondoid-water azeotrope.

19. The method of claim 18 further comprising adding furfural to said fractionation zone in amounts sufficient to form a diamondoid-furfural-water azeotrope.

* * * * *

UNITED STATES PATENT AND TRADEMARK OFFICE

CERTIFICATE OF CORRECTION

PATENT NO. : 5,139,621

DATED : August 18, 1992

INVENTOR(S) : R. A. Alexander and D. D. Whitehurst

It is certified that error appears in the above-identified patent and that said Letters Patent is hereby corrected as shown below:

ON THE TITLE PAGE:

In the Abstract, line 1, after "method" and before "for" add --is disclosed--

In Claim 1, line 2, "axeotrope" should read "azeotrope"

Signed and Sealed this

Twenty-first Day of September, 1993

Bruce Lehman

*Attest:*

BRUCE LEHMAN

*Attesting Officer*

*Commissioner of Patents and Trademarks*